US006976928B2

(12) United States Patent
Hemphill

(10) Patent No.: US 6,976,928 B2
(45) Date of Patent: Dec. 20, 2005

(54) SPORTS BALL SPOTTING APPARATUS

(76) Inventor: Charles Hemphill, P.O. Box 628, Safford, AZ (US) 85548-0628

( * ) Notice: Subject to any disclaimer, the term of this patent is extended or adjusted under 35 U.S.C. 154(b) by 72 days.

(21) Appl. No.: 10/114,407

(22) Filed: Apr. 1, 2002

(65) Prior Publication Data

US 2002/0151385 A1 Oct. 17, 2002

Related U.S. Application Data

(60) Provisional application No. 60/280,969, filed on Apr. 3, 2001.

(51) Int. Cl.[7] ..... A63B 61/00
(52) U.S. Cl. ..... 473/490; 473/415; 33/289
(58) Field of Search ..... 473/470, 47, 469, 473/467, 463; 33/289, 281, 282, 227; 362/103, 362/190, 191, 197, 269, 427

(56) References Cited

U.S. PATENT DOCUMENTS 3,741,662 A * 6/1973 Pioch ..... 356/399
3,752,588 A * 8/1973 Chapman ..... 356/141.1
3,985,356 A * 10/1976 Carlock ..... 33/289
4,090,708 A * 5/1978 McPeak ..... 33/289
4,681,396 A 7/1987 Jones
4,897,532 A 1/1990 Swartz et al.
5,067,245 A * 11/1991 Millard ..... 33/289
5,629,595 A 5/1997 Salter et al.
5,738,432 A * 4/1998 Okko et al. ..... 362/103
5,794,569 A * 8/1998 Titus et al. ..... 119/721
6,113,458 A * 9/2000 Brown ..... 446/438
6,328,733 B1 12/2001 Trost
2002/0089674 A1 * 7/2002 Lee et al. ..... 356/614

* cited by examiner

*Primary Examiner*—Jessica Harrison
*Assistant Examiner*—Alex F. R. P. Rada, II
(74) *Attorney, Agent, or Firm*—Mark Ogram

(57) ABSTRACT

An apparatus used to officiate sporting events in which the positioning of the ball on the field by the officials is critical to the play. The apparatus employs a laser beam which is directed by the official parallel to the field of play at a height below the width of the ball. In use, a first official directs the laser beam across the field to a second official who uses the laser beam illumination to properly "spot" the ball. In the preferred embodiment, the apparatus is mounted onto the shoe of the official; in another, the apparatus is placed on an edge marker.

6 Claims, 4 Drawing Sheets

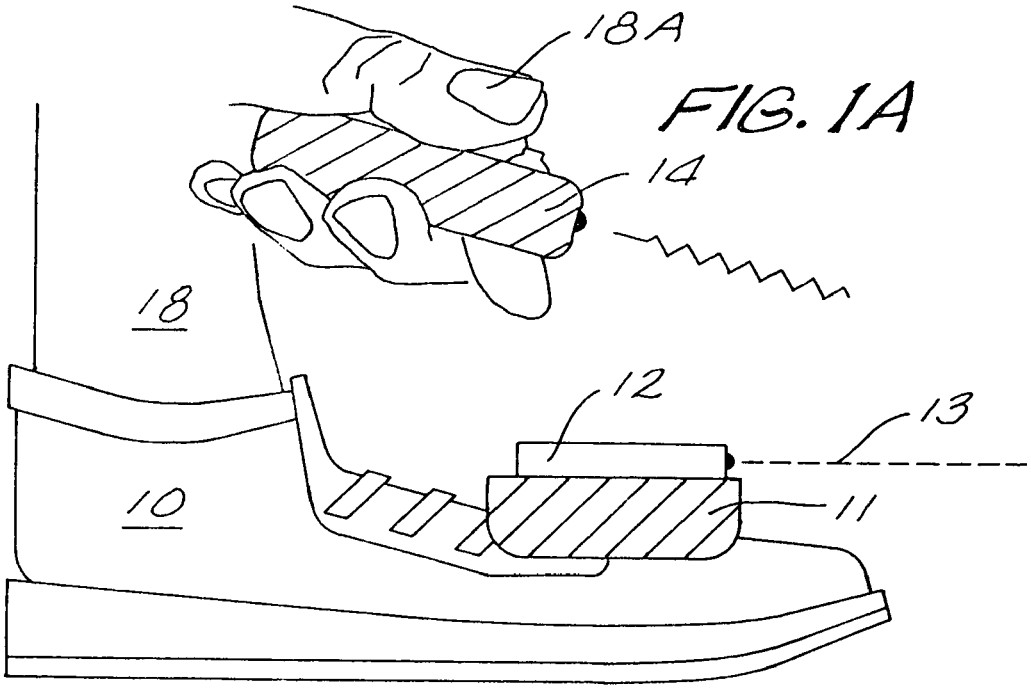
FIG. 1A
FIG. 1B
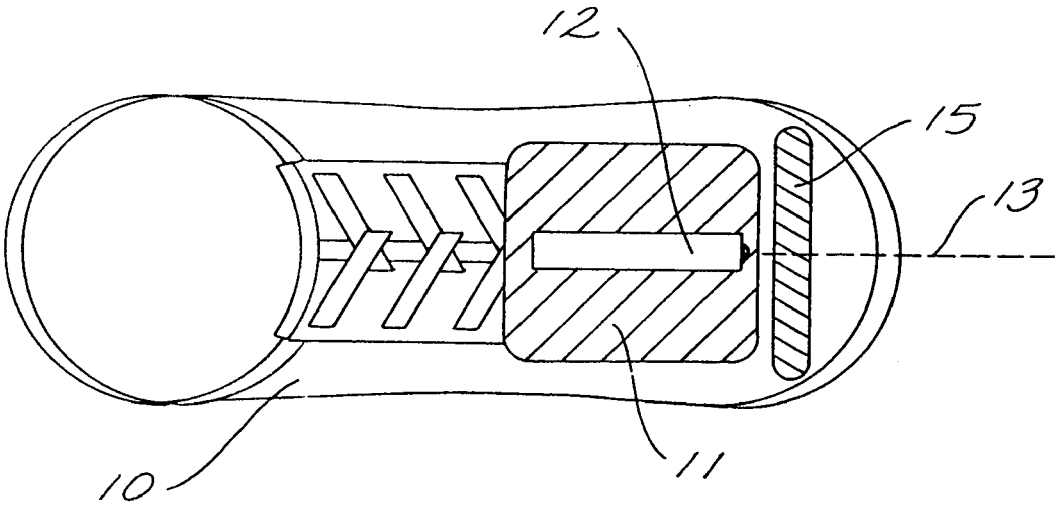

SPORTS BALL SPOTTING APPARATUS

Priority for this application is claimed from U.S. Provisional Patent application Ser. No. 60/280,969, filed on Apr. 3, 2001, and entitled, "Laser ball-spotting device to assist football officials/personnel to more accurately position the ball".

BACKGROUND OF THE INVENTION

While the present discussion deals with the sport of American football, those of ordinary skill in the art readily recognize that the present invention is also applicable to other sports where the accurate positioning of a ball or other article of play on a playing field is important to the playing of the game.

Football is said to be a "game of inches". This is particularly true where a question of "first down" is in question. Many games have been lost or won because of an inch or two. The difficulty with this procedure, besides the ability of the official to accurately know where the ball's nose was at the time the carrier was "down", is the proper positioning of the ball on the field of play.

To date, positioning of the football by the officials has been based solely on the sight judgments of the different officials on the field. For the most part, the spotting official has had to "guess" by sight using the foot placement of another official marking the "spot" of the ball. In other words, the official spotting the football after a play has been terminated outside the hash marks, locates the ball with his foot, picks up the football and tosses it to another official who in turns attempts to place the ball as close to the "spot" as possible.

This exchange of the ball, and it's placement can be off many inches (one way or the other).

It is clear from the foregoing that there is a significant need for a device which accurately positions the sports ball on the field of play.

SUMMARY OF THE INVENTION

The invention is an apparatus used to officiate sporting events in which the positioning of the ball on the field by the officials is critical to the play. While there are several such sporting events, this discussion will focus only on American Football where the "spotting" of the ball after a play is extremely critical as the "spot" determines if a first down has or has not been achieved.

The apparatus employs a laser beam. Those of ordinary skill in the art readily recognize a variety of lasers which can be employed herein. Some such lasers are described in: U.S. Pat. No. 6,238,733, issued to Trost on Dec. 11, 2001, and entitled "Hand-Held Laser Scanner"; U.S. Pat. No. 4,681,396, issued to Jones on Jul. 21, 1987, and entitled "High Power Laser Energy Delivery System"; and, U.S. Pat. No. 4,897,532, issued to Swartz et al. on Jan. 30, 1990, and entitled "Portable Laser Diode Scanning Head". All of these references are incorporated hereinto by reference.

The laser is directed by the official so that the beam is projected parallel to the field of play at a height below the width of the football. This laser beam establishes the proper "spotting" of the football on the hatch marks.

In use, a first official directs the laser beam across the field (perpendicular to the side line) to a second official who uses the laser beam illumination to properly "spot" the ball. The task of the second official is to move the ball until the tip of the ball (or another designated spot) is illuminated by the laser beam. Once the beam "touches" the nose of the ball, the ball is properly spotted.

In the preferred embodiment, the apparatus is mounted onto the shoe of the official. Using a button or a remote transmitter, the official is able to selectively activate the laser.

In the preferred embodiment, a line or other orienting mechanism is printed onto the shoe to assist in aligning the laser beam at right angles to the edge of the field of play.

In another embodiment, the apparatus is placed on an edge marker used along the edge of the playing field. The edge marker selectively emits the laser beam allowing the "spotting" official to position the ball.

In this manner, the apparatus, when mounted to the poles of the yard marker (commonly referred to as the "chains") or attached to the shoes of the officials, allow the football officials to accurately spot the ball on the field and to more accurately determine the location of the football on the field.

This apparatus allows officials to use the beam of light emitted by the beam from the ball-spotting apparatus to position the ball with more precision. Ideally, the device need not be much more powerful than the beams emitted from the laser pens sold commercially as the beam works as a marker for the official.

In another embodiment, the location of the ball can easily be determined with a laser-beam spotting device attached to yard marker/ edge marker. This embodiment is particularly useful for determining if a "first down" has been achieved.

The ideal size for this embodiment is about 8"×8"×6" deep. An opening for the beam is the height of a regulation-size football ball's tip to the field. In operation, the edge marker unit rests on the ground, and when activated, emits a beam across the field. If the tip of the ball penetrates that beam, then a first down is awarded.

To assist in aligning the laser perpendicular to the field of play, an aligning mechanism is employed such as a visual line which is positioned parallel to the edge of field marker.

In another embodiment, a buried cable along the edge of the field is "sensed" by the unit which notifies the official when proper alignment is obtained.

With the use of the edge marker as described above, the officials never have to bring the "chains" onto the field and literally guess as to where the markers were to be placed for a first down measurement.

In another embodiment of the invention, the unit is installed on each post; thereby eliminating the need to reverse the posts at the end of each quarter of play.

For the shoe embodiment, the laser beam spotting device is mounted on the official's shoe. To spot the ball, the laser is aligned and pointed with his foot while the ball is tossed to the other official who spots the ball using the projected beam as described above.

The invention, together with various embodiments thereof will be more fully explained by the accompanying drawings and the following explanation thereof.

DRAWINGS IN BRIEF

FIGS. 1A, 1B, and 1C are side, top, and operational views of the preferred embodiment of the invention mounted onto a shoe.

FIGS. 2A, 2B, 2C, and 2D graphically illustrate an alternative embodiment of the invention in which the laser is mounted on an edge marker.

Figure 5:
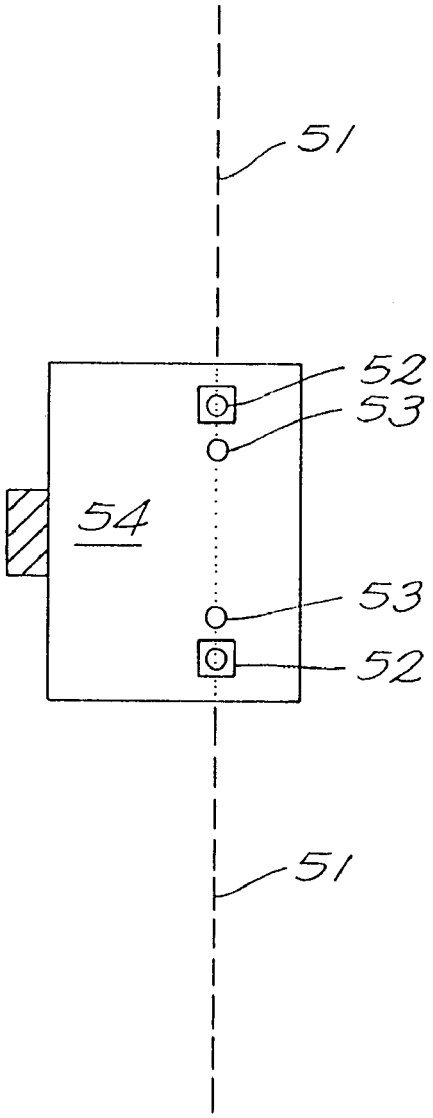

FIG. 5 diagrams the use of a buried electrical wire or conductor as a mechanism for properly aligning the edge marker.

DRAWINGS IN DETAIL

Figure 1C:
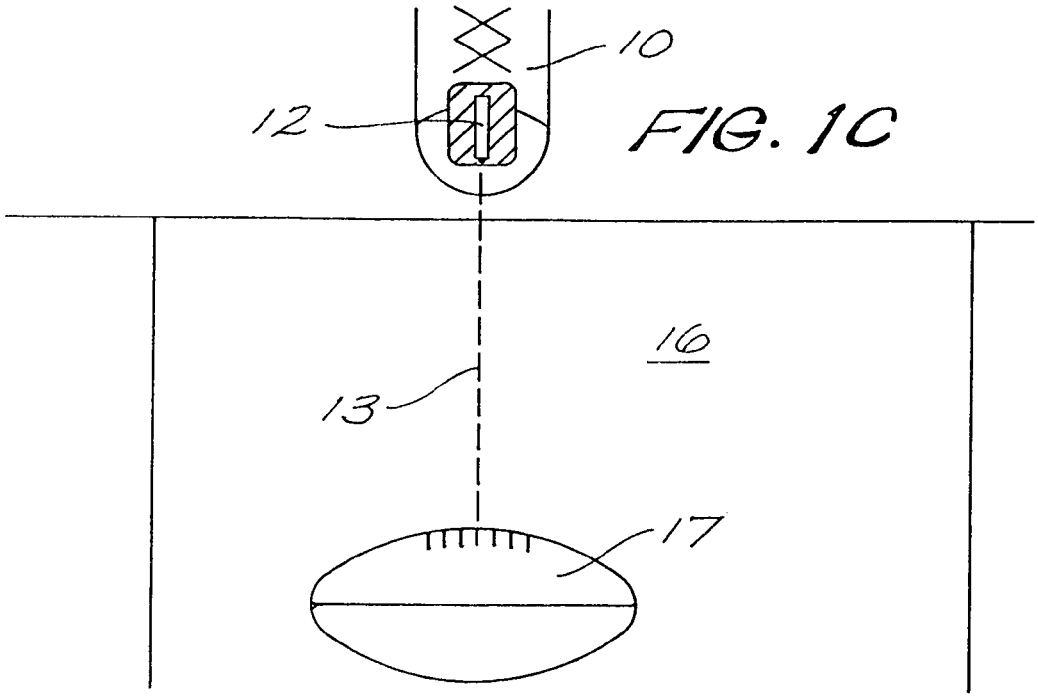

FIGS. 1A, 1B, and 1C are side, top, and operational views of the preferred embodiment of the invention mounted onto a shoe.

Referring to FIG. 1A, shoe 10 is worn by user/official 18. Platform 11 is mounted onto shoe 10 and provides a solid base to hold laser 12, which emits laser beam 13. In this embodiment, laser 12 is activated through the use of handheld transmitter 14 (activated by user's hand 18A). The signal from handheld transmitter 14 is received by laser 12; those of ordinary skill in the art readily recognize a variety of techniques which could be employed in this context.

Top view FIG. 1B, illustrates shoe 10 having platform 11 with laser 12 mounted thereon. Aligning stripe 15 is positioned perpendicular to laser beam 13 and is visible on the top of shoe 10. Aligning stripe 15 allows user 18 to position shoe 10 such that laser beam 13 is perpendicular to the playing field (when aligning stripe 15 is parallel to the edge of the field).

Once shoe 10 is properly positioned, as shown in FIG. 1C, laser 12 emits laser beam 13 onto playing field 16; thereby allowing football 17 to be properly "spotted" for the next play.

FIGS. 2A, 2B, 2C, and 2D graphically illustrate an alternative embodiment of the invention in which the laser is mounted on an edge marker.

Figure 2A:
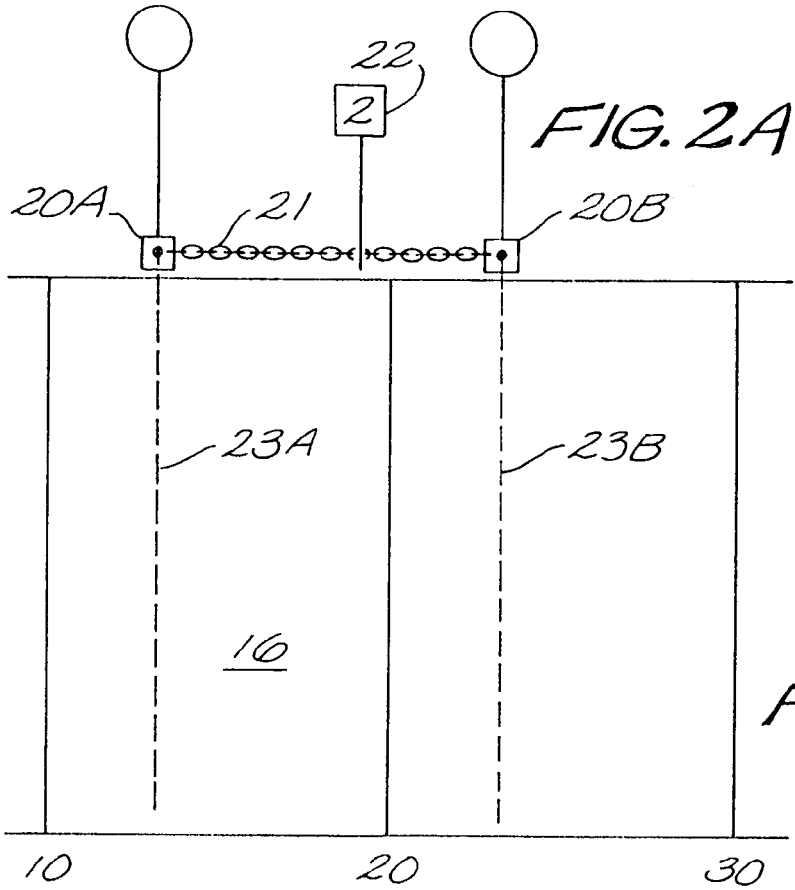

This embodiment of the invention, as shown in FIG. 2A, is adapted to be used by the edge markers (often called down markers). Playing field 16 is rectangular. When a first down occurs, it's beginning is marked by an edge marker 20A which is aligned using an embedded laser which emits a laser beam 23A striking the tip of the football. Chain 21 (ten yards in length) connects edge marker 20B with edge marker 20A; thereby establishing the distance which must be obtained to achieve another first down.

Edge marker 20B also selectively emits a laser beam 23B. This beam 23B is used to determine if the play has moved the ball so that the plane (established by laser beam 23B) is broken (hence, another first down).

Figure 2B:
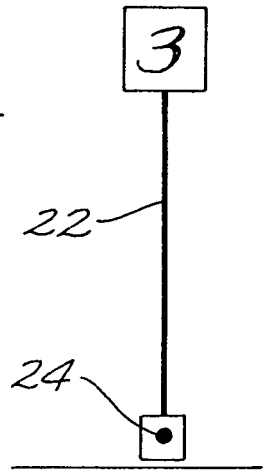

Referencing FIG. 2B, a laser 24 within down marker 22 assists in determining where the ball is currently in play. While down marker 22 does not figure into the determination of a first down, down marker 22 assists in informing the spectators, the coaches, and the players on what needs to be achieved in order to get another first down.

Figure 2C:
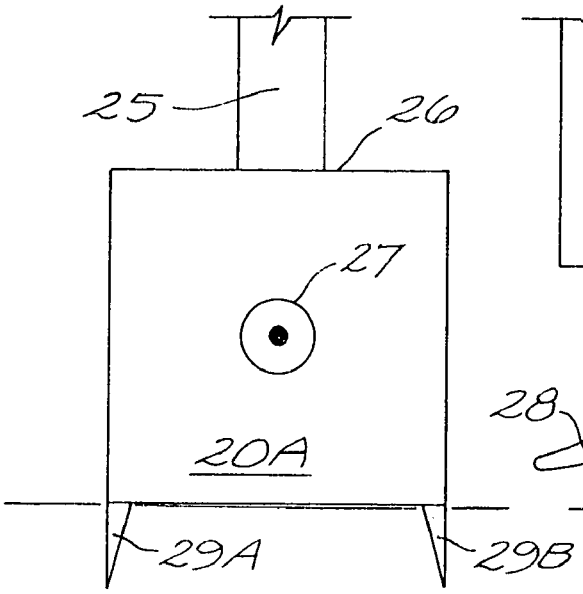

FIG. 2C illustrate the base of the edge markers described above. Edge marker 20A has vertical pole 25 extending from base 26. Vertical pole 25 is used by the attendant in moving and positioning edge marker 20A.

In this embodiment, base unit 26 is approximately 8"×8"×6" deep. Opening 27 allows the laser beam an exit portal and is positioned to be less than the height of a regulation-size football's nose from the field Base unit 26 rests on the ground and when activated by switch 28 (shown in FIG. 2D), emit a beam across the field. If the tip of the ball penetrates that beam, then a first down is awarded. In this manner, the officials would never have to bring the "chains" onto the field and literally guess as to where the markers were to be placed for a first down measurement.

Ground pegs 29A and 29B secure base unit 26 to the field.

Figure 2D:
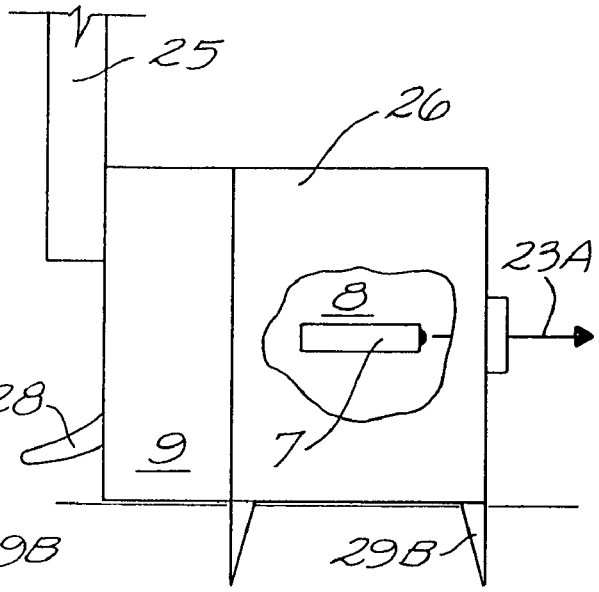

FIG. 2D gives a general structural layout for base unit 26. Contained within base unit 26 is laser 7 used to emit laser beam 23A. Besides cavity 8, for laser 7, battery compartment 9 holds the power source for operation of laser 7. Foot switch 28, permits the operator to activate laser 7.

This embodiment, where both edge markers are capable of emitting a laser beam, eliminates the current need to reverse the edge markers at the end of each quarter of play.

Figure 3:
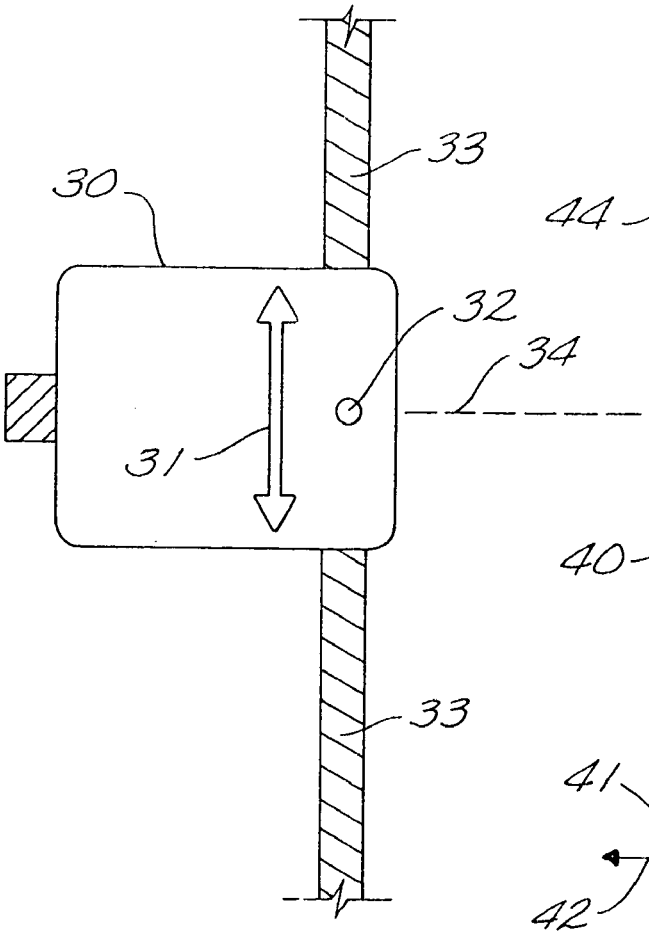
FIG. 3 is a top view of an edge marker showing the aligning indicia.

FIG. 3 is a top view of an edge marker showing the aligning indicia.

Base unit 30 is positioned along a field of play line 33 so that aligning indicia 31 runs parallel to field of play line 33. Once so aligned, laser beam 34 is perpendicular to the field of play; thereby assuring an accurate measurement.

Light 32 identifies when the laser (not shown in this illustration) is being activated.

Figure 4A:
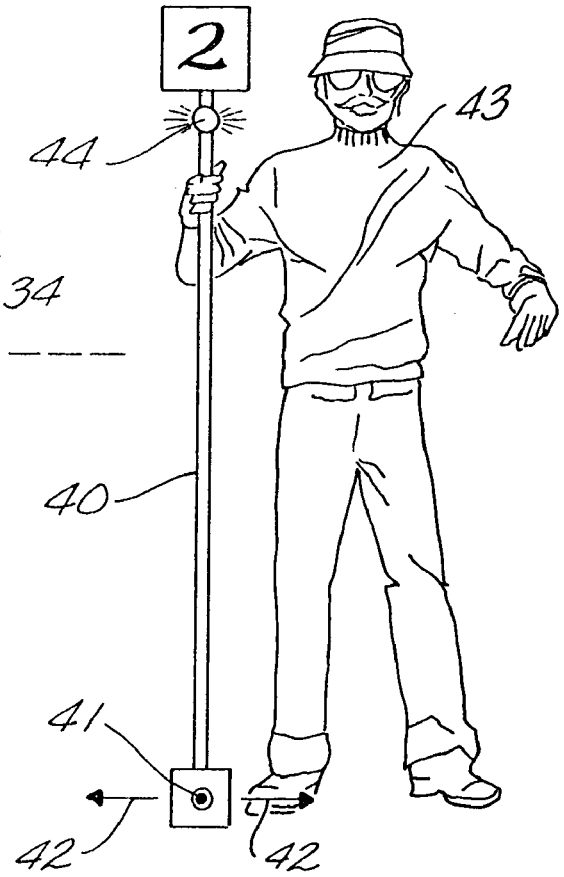
FIGS. 4A and 4B are pictorial and electrical diagrams of an embodiment of the invention in which the edge marker is properly positioned using the laser beam.
Figure 4B:
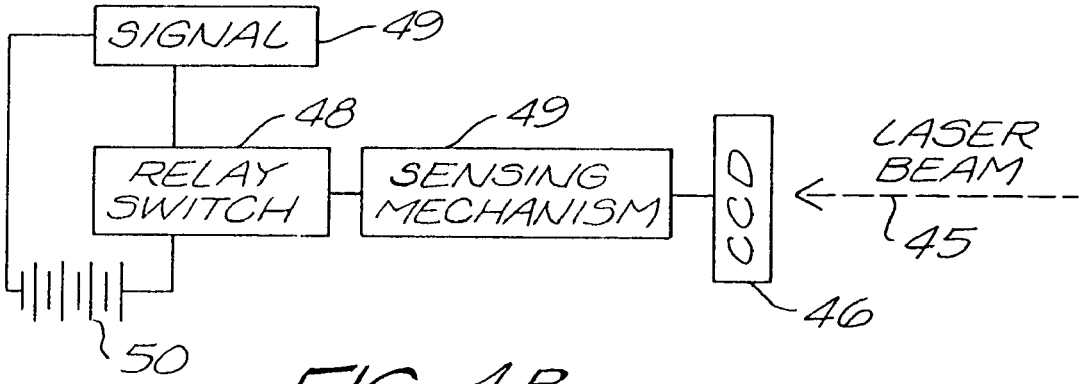

FIGS. 4A and 4B are pictorial and electrical diagrams of an embodiment of the invention in which the edge marker is properly positioned using the laser beam.

Referencing FIG. 4A, operator 43 is able to move down marker 40 as indicated by arrows 42. While this discussion relates to the down marker, the same mechanism is also useable by the edge markers either in conjunction with the lasers described above or not Operator 43 moves down marker 40 until the laser beam (not shown) passes through opening 41 and is sensed by the internal sensing mechanism (described in FIG. 4B). Once the laser beam is sensed, in this illustration, an auditory signal is generated by speaker 44, alerting operator 43 that the down marker is properly positioned.

In an alternative embodiment, instead of an auditory signal, a light is used to inform the operator of the proper positioning.

FIG. 4B outlines a sensing mechanism as used in FIG. 4A.

When laser beam 45 impinges on charge-coupled-device (CCD) 46, an electrical signal is generated which is identified by sensing mechanism 49. This causes sensing mechanism to close relay switch 48, allowing the electrical energy from battery 50 to pass through to the signaling device (either auditory or visual).

FIG. 5 diagrams the use of a buried electrical wire or conductor as a mechanism for properly aligning the edge marker.

In this embodiment of the invention, a wire or other conductor 51 is buried parallel to the field of play. As base unit 54 is moved over buried wire 51, wire sensors 52 identify when buried wire 52 is directly beneath them; when this occurs lights 53 are activated to notify the operator that proper alignment has been obtained.

Those of ordinary skill in the art readily recognize a variety of mechanisms which will obtain the result contemplated in FIG. 5. This includes the technology described in: U.S. Pat. No. 5,629,595, issued to Salter et al. on May 13, 1997, and entitled "Method and Apparatus for an Amusement Ride Having an Interactive Guided Vehicle"; and, U.S. Pat. No. 5,794,569, issued to Titus, et al. on Aug. 18, 1998, and entitled "Apparatus and Method for Electronic Confinement of Animals". Both of these patents are incorporated hereinto by reference.

It is clear the present invention provides for a highly useful and accurate apparatus for the accurate placement of the ball on a field of play.

What is claimed is:

1. A sporting assist apparatus comprising:

a) a laser adapted to selectively emit a laser beam; and, b) a handheld and portable platform holding said laser and is secured to a first moveable edge marker, said platform positioning said laser such that when a laser beam is emitted, said laser beam is projected substantially parallel to a playing field at a height less than a width of a ball used on said playing field and wherein said platform further includes an aligning indicia extending substantially vertical to said laser beam; and, c) a second movable edge marker having a vertical handle and a target, said second movable edge marker permitting a user to position said second movable edge marker in line with said emitted laser beam, said second movable edge marker having a signal mechanism located on said vertical handle proximate to a user's ear, said signal mechanism being responsive to said laser beam impinging on said target and generating an auditory signal for said user.

2. The sporting assist apparatus according to claim 1, a) further including a handheld transmitter selectively emitting a radio signal; and, b) wherein said laser is activated by said radio signal.

3. The sporting assist apparatus according to claim 2, further including:

a) a buried conductor extending parallel to the field of play proximate to an edge of the field; and, b) wherein said platform includes means for sensing said buried conductor and generating a user signal indicating a selected alignment with said buried electrical line.

4. The sporting assist apparatus according to claim 1, wherein said signal mechanism generates a visual signal.

5. A ball positioning mechanism having:

a) a laser secured to a handheld and movable platform such that when a laser beam is generated therefrom, said laser beam is projected substantially parallel to a playing field at a height less than a width of a ball used on said playing field; and, b) a movable edge marker having a vertical handle and a target, said movable edge marker permitting a user to position said movable edge marker in line with said emitted laser beam, said movable edge marker having a signal mechanism located on said vertical handle proximate to a user's ear, said signal mechanism being responsive to said laser beam impinging on said target and generating an auditory signal for said user.

6. The ball positioning mechanism according to claim 5, wherein said platform further includes an indicia extending substantially vertical to said laser beam.

* * * * *